US006161352A

United States Patent [19]

Fröhlich

[11] Patent Number: 6,161,352

[45] Date of Patent: Dec. 19, 2000

[54] SHEAR REINFORCEMENT SYSTEM FOR A SLAB FLOOR

[75] Inventor: Klaus Fröhlich, Pforzheim, Germany

[73] Assignee: Halfen GmbH & Co., Germany

[21] Appl. No.: 08/644,523

[22] Filed: May 10, 1996

[30] Foreign Application Priority Data

May 11, 1995 [EP] European Pat. Off. ..... 95 107 129

[51] Int. Cl.[7] ..... E04C 5/07

[52] U.S. Cl. ..... 52/334; 52/414

[58] Field of Search ..... 52/699, 649.8, 52/649.1, 600, 414, 334, 335, 336, 300, 301

[56] References Cited

U.S. PATENT DOCUMENTS

| | | | |
|---|---|---|---|
| 928,475 | 7/1909 | Simpson | 52/649.8 |
| 1,090,545 | 3/1914 | Kneas | 52/699 X |
| 1,245,414 | 11/1917 | Widmer | 52/699 |
| 1,502,766 | 7/1924 | Curley | 52/699 |
| 1,726,286 | 8/1929 | Bennet | 52/699 |
| 1,761,800 | 6/1930 | Preis | 52/699 |
| 1,898,668 | 2/1933 | Jones et al. | 52/649.1 X |
| 1,922,479 | 8/1933 | Joslin | 52/699 X |
| 3,283,458 | 11/1966 | Gersovitz | 52/649.1 X |
| 3,841,046 | 10/1974 | Scicchitano et al. | 52/649.8 X |
| 3,982,363 | 9/1976 | Dorris | 52/699 X |
| 4,888,922 | 12/1989 | Lancelot | 52/699 X |
| 5,174,910 | 12/1992 | Pita | 52/699 X |

FOREIGN PATENT DOCUMENTS

| | | |
|---|---|---|
| 0121510 | 10/1984 | European Pat. Off. . |
| 0495334 | 7/1992 | European Pat. Off. . |
| 356657 | 7/1905 | France . |
| 198603 | 12/1906 | Germany . |
| 2727159 | 12/1978 | Germany . |
| 2829941 | 1/1980 | Germany . |
| 3411591 | 6/1985 | Germany . |
| 3423284 | 1/1986 | Germany . |
| 4315900 | 7/1994 | Germany . |
| 430999 | 12/1964 | Switzerland . |
| 463070 | 3/1965 | Switzerland . |
| 9312305 | 6/1993 | WIPO . |

*Primary Examiner*—Michael Safavi
*Attorney, Agent, or Firm*—Robert W. Becker & Associates

[57] ABSTRACT

A shear reinforcement system for a slab floor has at least one elongate shear reinforcement member positioned transverse to the plane of the slab floor. At least one securing element for securing at least one of the elongate shear reinforcement members is provided. The at least one securing element extends transverse to the at least one elongate shear reinforcement member.

27 Claims, 11 Drawing Sheets

Fig. 16
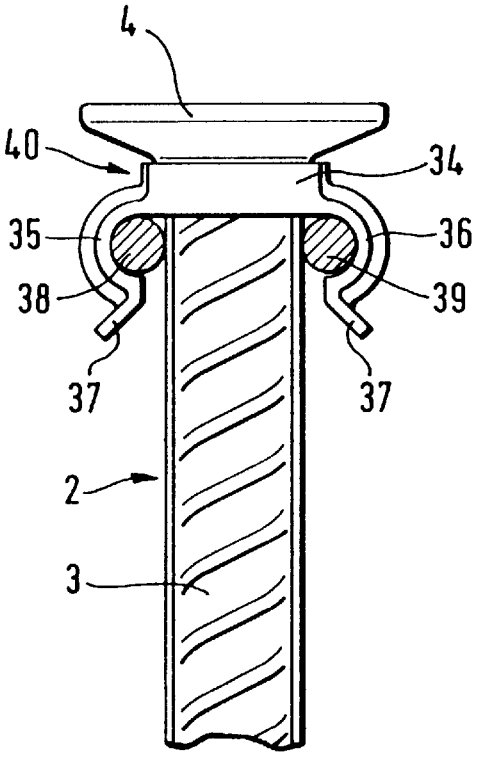
Fig. 17
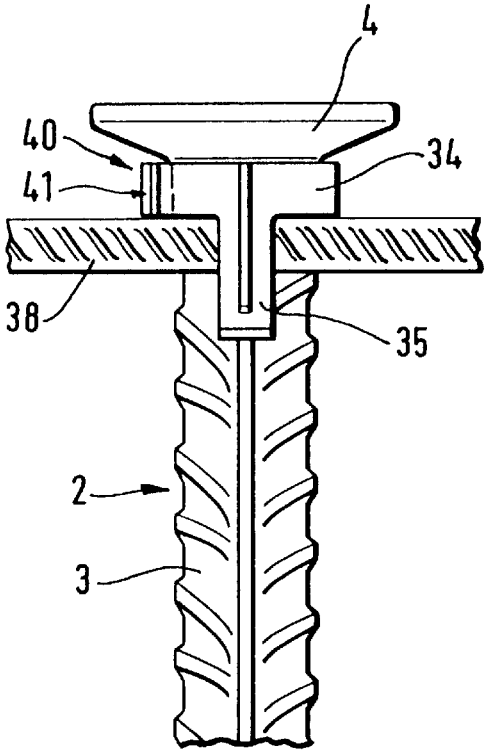
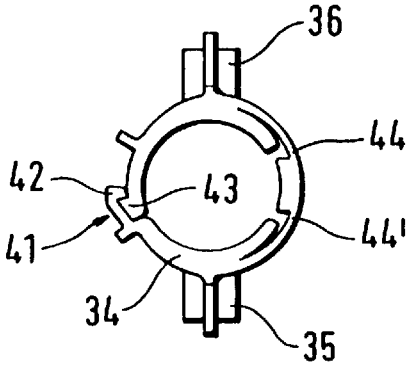
Fig. 18

SHEAR REINFORCEMENT SYSTEM FOR A SLAB FLOOR

BACKGROUND OF THE INVENTION

The present invention relates to a shear reinforcement system for slab floors/ceilings with at least one elongate shear reinforcement member that is positioned with its longitudinal axis at an angle to the slab floor/ceiling.

In European Patent Application 0 495 334 a shear reinforcement system for slab floors is disclosed which employs as shear reinforcement members a plurality of reinforcement bars extending substantially perpendicular to the surface of the slab floor within the interior of the slab floor. These reinforcement bars are provided at their upper and lower ends with a conically enlarged head and, with their upper ends, are welded in groups to a spacing element. This spacing element rests on a bending reinforcement structure and has sections that extend parallel to the plane of the slab floor with a predetermined minimum length so that the substantially perpendicularly extending reinforcement bars which extend through the bending reinforcement system will not be lost during curing of the concrete. Due to the welding connection between the spacing element and the reinforcement bars, these systems can only be inserted into the concrete mold as a unit so that the distances of the reinforcement bars must be adapted to the mesh width of the grid-shaped bending reinforcement system so that the reinforcement bars can be threaded from above through the bending reinforcement system. Furthermore, the length of the reinforcement bars must be adjusted to the height of the bending reinforcement system within the concrete mold. With such a shear reinforcement system it is thus impossible to be flexible with respect to different construction-technical specifications in individual cases. Also, a plurality of different systems must be manufactured and provided because the shear reinforcing system, i.e., the reinforcement bars, depending on the construction of the slab floor and the requirements for load resistance, must be provided at different distances relative to one another. Due to the welding connection these distances, however, are predetermined for each individual shear reinforcement system.

In German Patent 27 27 159 a shear reinforcement system for slab floors, supported on concrete supports and consisting of steel or prestressed concrete, is disclosed in which reinforcement bars extending perpendicularly to the plane of the slab floor are welded to a flat steel band. In this embodiment the reinforcement bars can also only be introduced into the concrete mold as a premanufactured unit whereby the grid-shaped bending reinforcement system must be inserted subsequently while threading simultaneously the reinforcement bars through the grid. This shear reinforcement system also has the aforementioned disadvantages.

It is therefore an object of the present invention to provide a shear reinforcement system for slab floors of the aforementioned kind with which the connection of the shear reinforcement members with the securing elements can be carried out at any desired point in time, especially also for insertion into the concrete mold whereby the distance between two sequentially arranged shear reinforcement members can be selected according to various requirements.

SUMMARY OF THE INVENTION

A shear reinforcement system for a slab floor according to the present invention is primarily characterized by:

At least one elongate shear reinforcement member positioned transverse to a plane of the slab floor;

At least one securing element for securing at least one of the elongate shear reinforcement members;

The at least one securing element extending transverse to the at least one elongate shear reinforcement member.

Preferably, the elongate shear reinforcement member is a bolt having a first and a second end. At least the first end has a head. The bolt is insertable into the securing element.

Advantageously, the securing element is a rail for receiving a plurality of the elongate shear reinforcement members.

Expediently, the rail is comprised of a non-rusting material, preferably plastic material.

Advantageously, the rail has a C-shaped cross-section with a base and lateral edges, wherein the lateral edges engage from behind the heads of the elongate shear reinforcement members.

Preferably, the heads have a circular arc-shaped contour with opposed flattened portions. The width B of the head between the flattened portions is smaller than the distance A between the lateral edges.

In another embodiment of the present invention, the rail has a U-shaped cross-section with sidewalls, the sidewalls having wall portions delimited by perforations, wherein the elongate shear reinforcement members are secured in the rail by bending the wall portions inertly behind the heads.

Advantageously, the rail has a U-shaped cross-section with the bottom and upwardly extending legs, wherein the bottom has downwardly projecting first bottom sections, engaging from below the heads, wherein the heads have an end face and wherein the bottom has support surfaces at which the end face of the heads rest.

Preferably, the support surfaces are formed by second bottom sections bent after mounting of the elongate shear reinforcement members so as to rest at the end faces.

Preferably, the rail has inwardly extending projections in a regular arrangement.

Preferably, the head has depressions at the circular arc shaped contour between the flattened portions. The inwardly extending projections include a set connected to the base. The set of the inwardly extending projections engage the depressions.

Advantageously, the rail has inwardly extending projections in a regular arrangement.

The lateral edges have slots and the heads have integral projections engaging the slots.

In another embodiment of the present invention, the rail has a U-shaped cross-section with sidewalls, wherein the sidewalls have evenly spaced openings.

Preferably, the securing element is clamped to a shaft of the elongate shear reinforcement member and comprises connectors for fastening the securing element to horizontally extending reinforcement bars of the slab floor, wherein the securing element is positioned directly adjacent to the head of the elongate shear reinforcement member.

The securing element has a ring clamp and the ring clamp has at a first location of its circumference a closure and at a second location remote from the first location a joint. The joint comprises at least one portion of the ring clamp being thinner than the remainder of the ring clamp in order to allow bending.

The securing element encloses at least a portion of a circumferential edge of the head and has fasteners for fastening the securing element to reinforcement bars of the slab floor.

The securing element encloses the circumferential edge of the head along an angular distance of substantially 220°.

In yet another embodiment of the present invention, the securing element comprises a disc having first and second opposed surfaces and further comprising a first ring segment connected to the first opposed surface. The head is received in the ring segment and the first opposed surface covers an end face of the head.

The securing element comprises a second ring segment connected to the second opposed surface for receiving the head of a coaxially arranged further one of the shear reinforcement members.

Advantageously, the inventive system further comprises fasteners connected to the securing element for fastening the securing element to horizontally extending reinforcement bars of the slab floor.

Two of the fasteners are provided and the fasteners are snap brackets enclosing the reinforcement bars. They are arranged opposite one another at the securing element.

In another embodiment of the present invention the snap brackets are arranged in a plane that is displaced relative to the plane of the securing element.

Preferably, the disc of the securing element comprises a fastening connector at the second opposed surface for fastening the securing element to the rail.

In yet another embodiment of the present invention this securing element is a rail structure with openings and the shear reinforcement members have connectors engaging the openings. Preferably, the connectors are T-shaped members inserted through the openings and engaging behind the rail structure with lateral arms of the T-shaped member.

The essential advantages of the present invention are to be seen in that the shear reinforcement members are easily connected with the securing elements with positive locking connections and are detachable at least until the final determination of the distances between neighboring reinforcement members is completed. Thus, an adaptation to individual constructional requirements and specifications is possible. Especially favorable is that the shear reinforcement system can be manufactured at the site by assembling the individual parts whereby the shear reinforcement members can be arranged in any desired pattern according to the respective specifications and requirements. A further advantage is that the material of the securing elements may be plastic material so that corrosion-preventive measures are obsolete.

Expediently, the shear reinforcement members, in a manner known per se, have essentially the shape of a bolt. At least one end of its shaft has a head. Such a head not only results in an especially favorable force transmission between the reinforcement system and the concrete, but also serves for fastening the shear reinforcement members at the securing elements. Such a securing element is, according to a preferred embodiment, a rail to which a plurality of shear reinforcement members can be fastened and which is preferably comprised of rustproof material so that the rail can at the same time provide a protective cover for the shear reinforcement members. Expediently, the rail is a C-shaped profile (i.e., has a C-shaped cross-section), whereby the lateral edges of the C-shaped profile engage behind the head of the share reinforcement members. In this context it is advantageous that the head has a partly circular arc shaped contour and is provided at two opposed sides with flattened portions whereby the distance between the flattened portions is smaller than the distance of the lateral edges of the C-shaped profile. In this manner, the head can be inserted into the rail such that its flattened portions extend in the longitudinal direction of the rail. By rotating the shear reinforcement members about their longitudinal axis, a positive locking connection, for example, in the manner of a bayonet closure, is provided. Additional fastening means, for example, screws or clamps are no longer needed.

According to a further expedient embodiment of the rail, the rail has a U-shaped profile (i.e., has U-shaped cross-section) whereby the head of the shear reinforcement members are secured by inwardly bent wall portion of the U-shaped profile. The respective wall portions, for facilitating bending thereof, are delimited by perforations in the form of slots or notches provided in the lateral sidewalls of the U-shaped profile. The U-shaped profile can be designed such that at the bottom downwardly projecting first bottom sections are provided that engage from below the heads of the reinforcement members. Depending on the specific design, the shear reinforcement members can be inserted with their head laterally between the downwardly projecting first bottom sections. However, according to another embodiment the bolt shaft can be inserted from above through an opening positioned between the downwardly projecting first bottom sections so that the head comes to rest at the downwardly projecting first bottom sections.

In addition to clamping the head of the shear reinforcement members in the profile of the rail as described above, the profile may be provided with inwardly extending projections (noses or curved portions) that are preferably arranged in a regular pattern. With these noses or curved portions it is possible, even when the clamping force between the head and the profile is not sufficient, to provide for a secure positioning especially against longitudinal displacement of the head within the rail. With a respective design, the curved projections or noses act as a catch whereby the catch connection allows for a desired detachment of the reinforcement member from the rail, for example, in order to correct its position. For such a catch connection the end face of the head may be provided with a depression into which the curved portion (nose) provided at the base of the profile can be inserted. The distance between adjacent projections in the longitudinal direction of the rail should substantially correspond to the diameter of the head so that optionally a very tight sequence of shear reinforcement members can be provided at the rail. Another embodiment for securing the head against displacement within the longitudinal direction of the rail is that at the lateral edges recesses are provided which are engaged by projections provided at the head of the bolt.

In order to avoid that the rails only loosely rest on the reinforcement members of the upper bending reinforcement system of the slab floor, but instead are connectable without additional fastening means with the bending reinforcement system, it is especially expedient to provide openings at the lateral edges of the U-shaped profile. These openings are, for example, arranged in a regular pattern or spaced at an equal distance along the rail so that the reinforcement members of the bending reinforcement system can be guided therethrough. A further preferred embodiment of the invention is embodied such that the securing element surrounds the shaft of the shear reinforcement bars and is provided with means for fastening at the horizontally extending reinforcement members whereby preferably the securing element is positioned directly adjacent to the head of the shear reinforcement member. With such a securing element, the fastening of individual shear reinforcement members at the already present reinforcement bars of the upper bending reinforcement system is possible, whereby the distance of the neighboring reinforcement members can be freely selected according to respective specifications. Such a securing element comprises preferably a clamp that is in the form of a ring which at one location of its circumference is provided with a closure and at a location remote from the location of the closure is provided with a joint which preferably is a strip portion thinner than the remainder of the ring so that bending is possible at this location. Such securing elements can be manufactured in a simple manner as an injection molded plastic part.

A further embodiment of a securing element for individually fastening shear reinforcement members at reinforcement bars of the upper bending reinforcement system is that the securing element partly surrounds the circumferential edge of the head of the shear reinforcement member whereby the angular distance of enclosure is preferably 220° and whereby the securing element is provided with means for fastening it to the reinforcement bars. The securing elements for the individual fastening of shear reinforcement members are expediently provided with lateral snap brackets for surrounding the reinforcement bars whereby preferably at least two diametrically opposed snap brackets are provided at the securing element.

As a further possibility of a positive locking connection of a shear reinforcement member with a rail the following embodiment is suggested. A rail is provided with openings through which extends a connecting means of the reinforcement member. Such a connecting means can, for example, be a screw threaded into a threaded bore at the end face of the shear reinforcement member. In order to avoid the need for separate fastening means and tools, it is advantageous that this connecting means is a T-shaped member connected to the end face of the reinforcement member and is inserted through the openings of the rail. The lateral arms engage behind the rail when turned.

BRIEF DESCRIPTION OF THE DRAWINGS

The object and advantages of the present invention will appear more clearly from the following specification in conjunction with the accompanying drawings, in which:

FIG. 16 shows a share reinforcement member with annular securing element (ring clamp);

FIG. 17 shows a view of the embodiment of FIG. 16 rotated by 90°;

FIG. 18 shows the annular securing element as an individual part;

DESCRIPTION OF PREFERRED EMBODIMENTS

The present invention will now be described in detail with the aid of several specific embodiment utilizing FIGS. 1 through 26.

Figure 1:
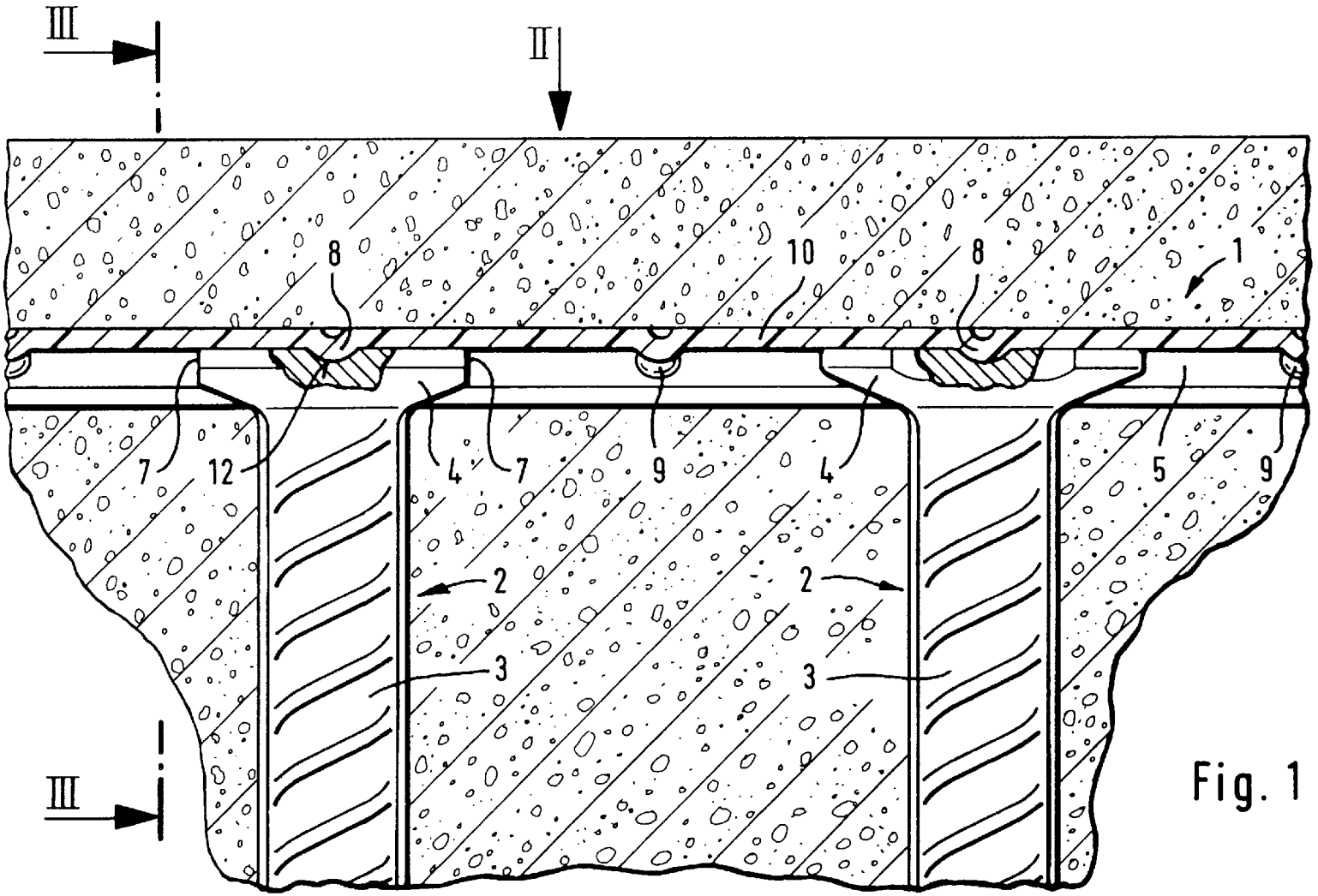
FIG. 1 shows a longitudinal section of a rail with shear reinforcement members embedded in a concrete slab floor.
Figure 3:
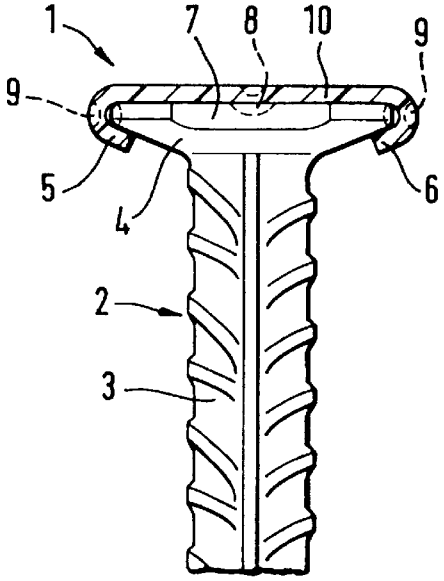
FIG. 3 shows a section along the line III—III of FIG. 1.
Figure 2:
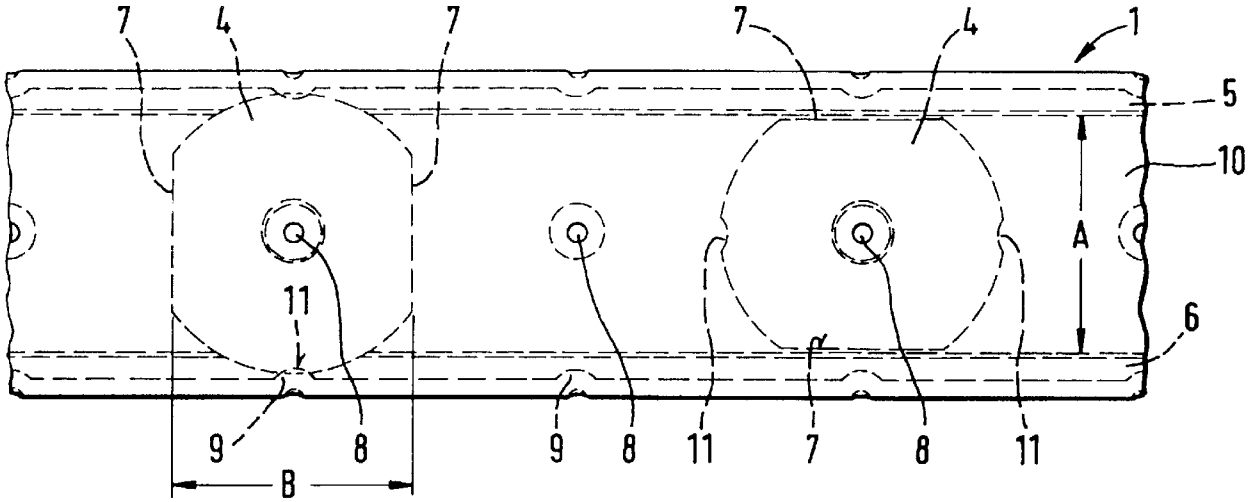
FIG. 2 shows a view in direction of arrow II of FIG. 1.

In FIGS. 1 to 3 a securing element 1 in the form of a rail 10 of a C-shaped profile with shear reinforcement members 2 arranged thereat is shown. The securing element 1 can be made of metallic materials or especially of plastic material. The shear reinforcement members 2 are in the form of bolts 3 with a shaft having an integral head 4 formed at one end. Preferably, the bolt 3 is provided at both ends with a head 4 so that the shear reinforcement member 2 is identical at both ends. As shown in FIG. 3, the lateral edges 5 and 6 of the rail 10 engage behind the head 4 of the shear reinforcement member 2 so that the head 4 is securely held within the rail 10.

As is especially shown in FIG. 1, in the longitudinal direction of the rail 10 curved projections 8 and 9 are provided. The curved projections 8 are provided at the base of the profiled member and the curved projections 9 are provided at the lateral edges 5 and 6. These curved projections 8 serve to fix the shear reinforcement member 2 in the longitudinal direction of the rail. At the head 4 of the bolt 3 corresponding depressions 11 and 12 are provided so that the curved projections 8, 9 in a positive locking manner engage these depressions 11, 12 as soon as the head 4 has reached the predetermined position within the rail 10. As can be seen especially clearly in FIG. 2, the heads 4 of the bolt 3 are substantially circularly designed and provided with two oppositely positioned flattened portions 7 whereby these flattened portions 7 extend parallel to one another.

The width B of the head 4 between the flattened portions 7 is slightly smaller than the distance A between the lateral edges 5 and 6 so that the head 4 can be inserted from the open side of the C-shaped profile into the rail 10. For this purpose, the head 4 with its flattened portions 7 is aligned such that the flattened portions 7 extend in the longitudinal direction of the rail 10. As soon as the head 4 with its end face rests at the base of the rail 10, the bolt 3 is turned about its longitudinal axis so that the circular arc-shaped sections of the contour of the head 4 extend perpendicular to the longitudinal direction of the rail 10. In this position the curved projections 9 engage the depressions 11 at the edge of the head 4 and thereby lock the shear reinforcement member 2 in the predetermined position at the securing element 1.

Figure 6:
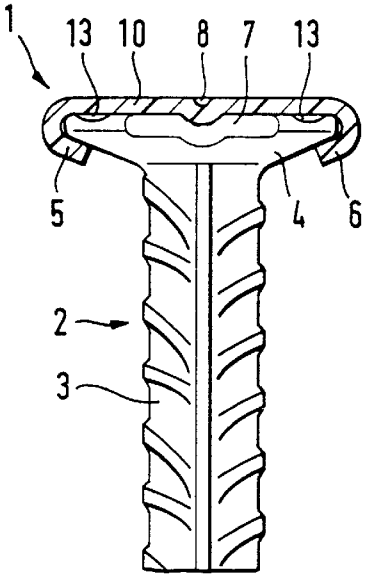
FIGS. 4 to 6 show a further embodiment of the design of FIGS. 1–3.
Figure 4:
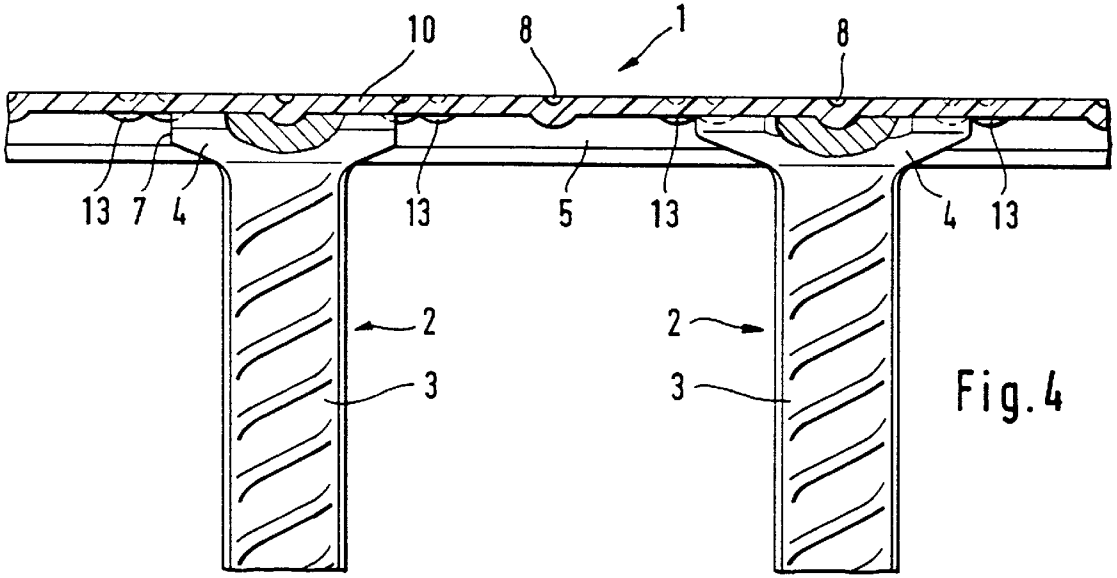
Figure 5:
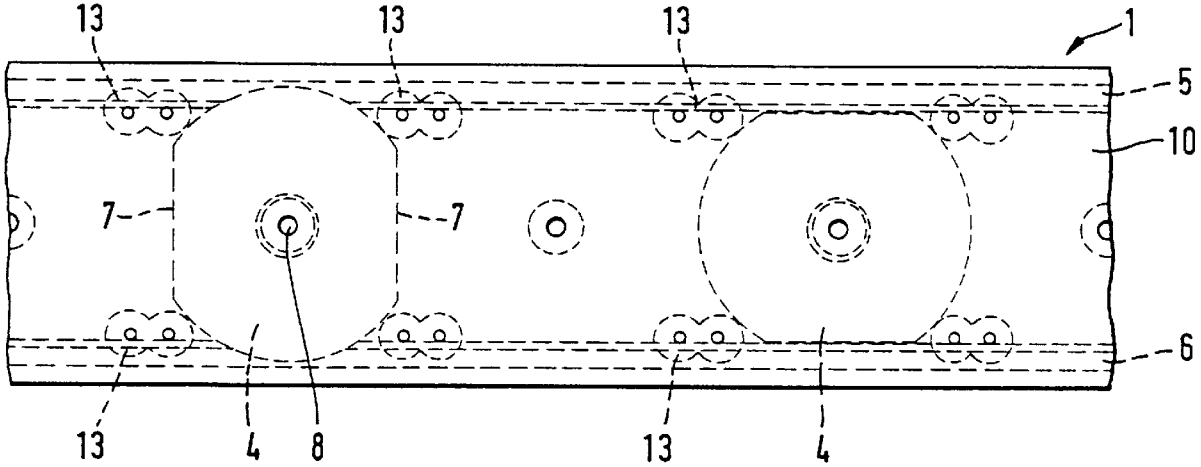

The embodiment represented in FIGS. 4 to 6 corresponds substantially to the embodiment of FIGS. 1 to 3 so that for same parts the same reference numerals are being used as in the aforedescribed embodiment. Different in this arrangement is the means for fixing the head 4 of the shear reinforcement member 2 which in the embodiment of FIGS. 4 to 6 is not provided at the lateral edges 5 and 6 of the rail 10, respectively, at the circumferential edge of the head 4 but is provided in the form of curved projections 13 at the base of the rail 10. These projections 13 are located directly at the circumference of the head 4 so that the reinforcement member, in the longitudinal direction of the rail 10, is secured by respectively two projections 13 and, in addition, by projections 8 against displacement. In this manner, only the rail 10 must be provided with projections 8, 13, and at the circumferential edge of the head 4 no matching depressions must be provided.

Figure 9:
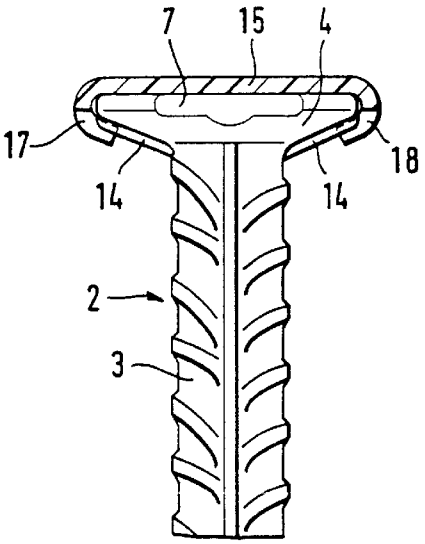
FIGS. 7 to 9 show another embodiment of the design of FIGS. 1–3.
Figure 7:
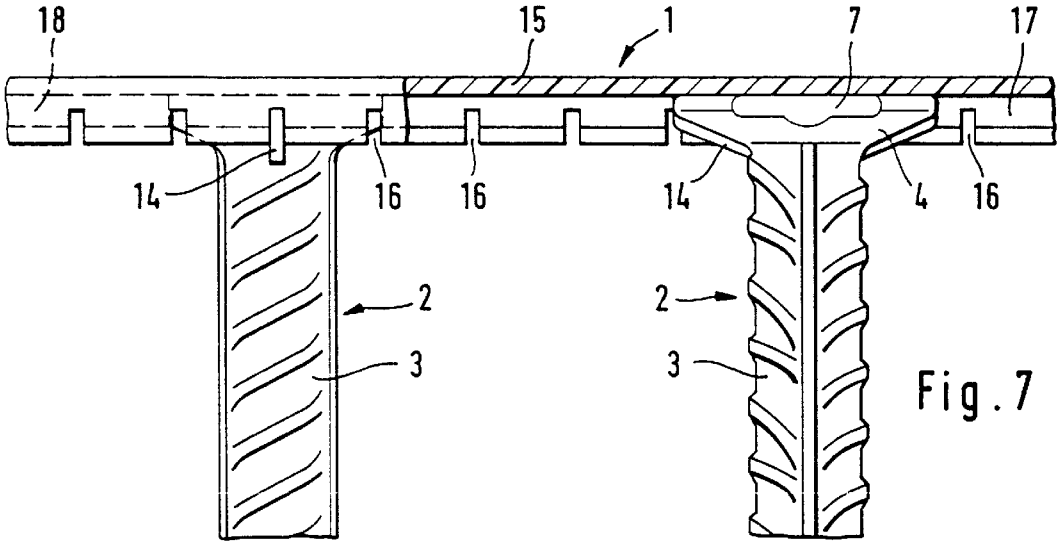
Figure 8:
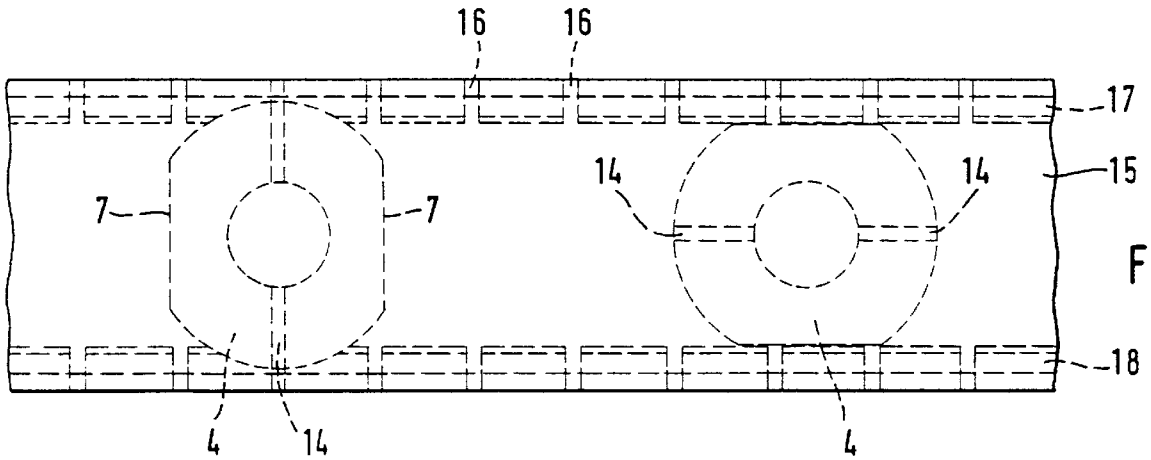

The embodiment represented in FIGS. 7 to 9 shows a securing element 1 which is a rail 15 having a C-shaped crosssection with lateral edges 17 and 18. The lateral edges 17 and 18 are provided transverse to the longitudinal direction of the rail 15 with slots 16 at identical intervals which are engaged by integral projections 14 of the head 4. In this manner the shear reinforcement member 2 is arrested in the longitudinal direction of the rail 15. The rail 15 is preferably made of plastic material whereby the plastic material must have a sufficient elasticity in order to, after a previous widening required to introduce the projections 14 into the corresponding slot 16, be able to return into its initial shape. In the embodiment of FIGS. 7 to 9 the heads 4 are also provided with flattened portions 7 so that a fastening of the shear reinforcement member 2 at the securing element 1 is possible in the same manner as disclosed in connection with FIGS. 1 to 3.

Figure 11:
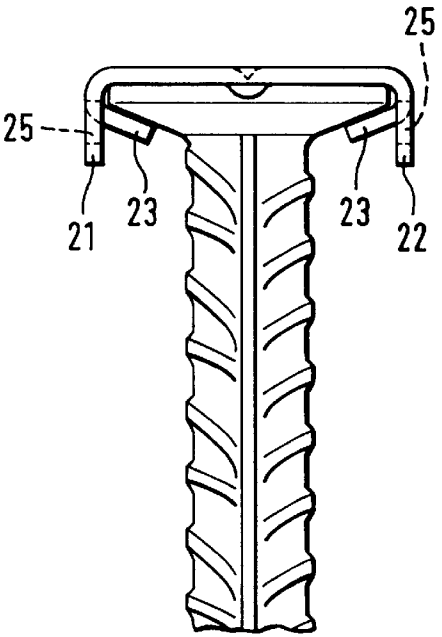
FIG. 11 shows a section along the line XI—XI of FIG. 10.
Figure 10:
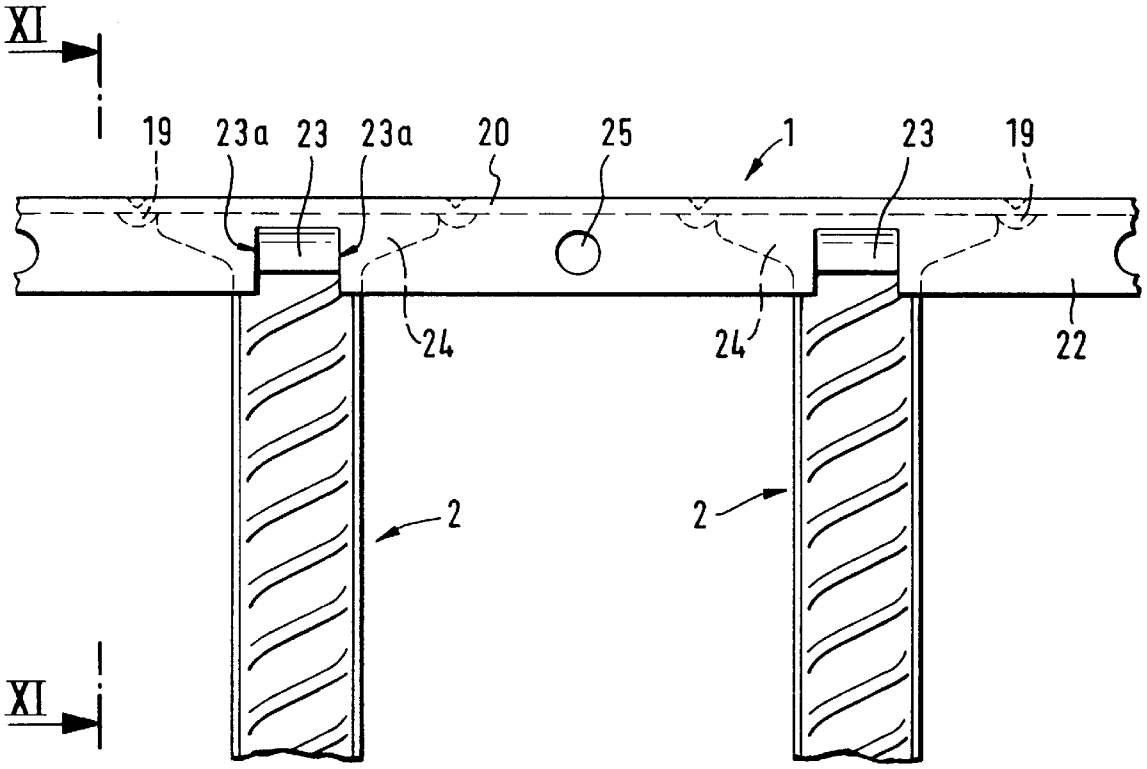
FIG. 10 shows a side view of a rail with shear reinforcement members.

FIGS. 10 and 11 show a securing element 1 that is comprised of a rail 20 with a U-shaped profile and thus has lateral sidewalls 21, 22 extending at a right angle to the bottom of the rail 20. The shear reinforcement members 2 are provided with heads 24 having end faces that have a circular or square contour. For fastening the shear reinforcement members 2 to the securing elements 1, the heads 24 with their end face are brought into contact at the rail 20 and subsequently wall portions 23 of the lateral side walls 21 and 22 are bent inwardly so that they secure the head 24 in a fixed position at the bottom of the rail 20. In order to secure the shear reinforcement members 2 against displacement in the longitudinal direction of the rail 20, the base surface (bottom) is provided with curved projections 19 which are positioned directly adjacent to the heads 24 and in this manner exactly fix their position. In order to determine the axial length of the wall portion to be bent, the lateral sidewalls can be provided with perforations in the form of slots 23*a* or notches. In the lateral sidewalls 21 and 22 bores 25 (openings) are provided which for example serve to guide therethrough the reinforcement bars.

Figure 13:
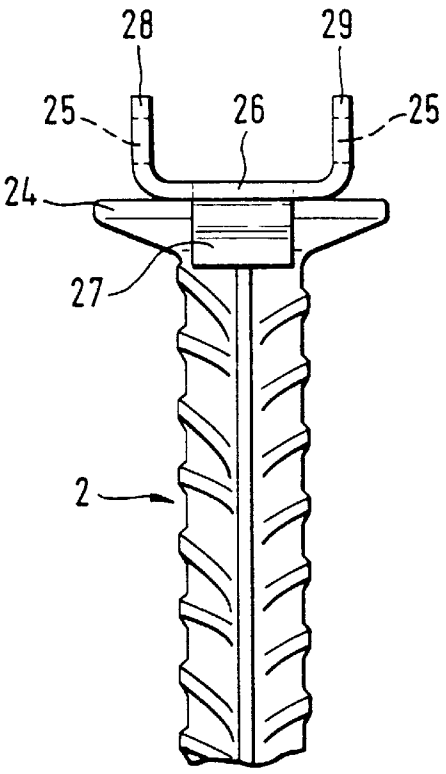
FIGS. 12 and 13 show a further embodiment of the design of FIGS. 10–11.
Figure 12:
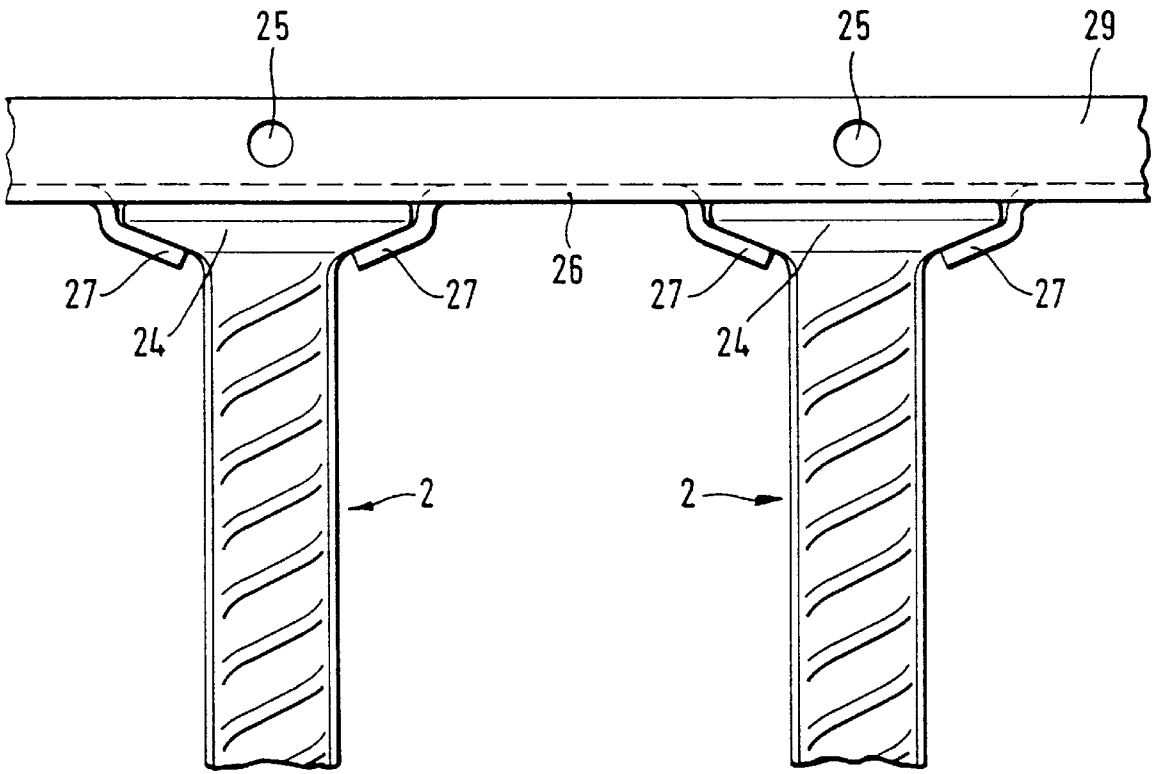

The embodiment according to FIGS. 12 and 13 shows shear reinforcement members 2 with heads 24 which are fastened at a rail 26 with U-shaped profile. The width of the rail is less than the diameter of the head 24 and the open end of the U-shaped profile faces away from the shear reinforcement member 2. At the bottom of the rail 26 downwardly projecting bottom sections 27 are provided which are designed such that they engage behind the head 24 of the shear reinforcement members 2 so that the head 24 is forced against the bottom of the rail 26. Within the lateral edges 28 and 29 of the rail 26 openings 25 are provided which serve for receiving the reinforcement bars.

Figure 15:
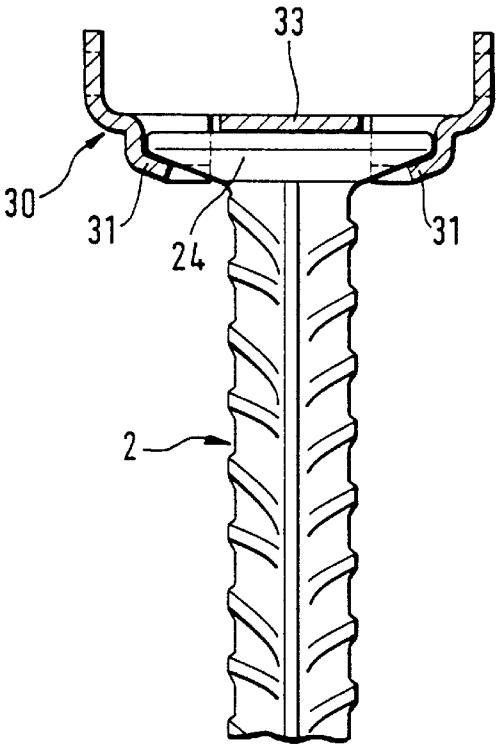
FIGS. 14 and 15 show a further embodiment of the design of FIGS. 10–11.
Figure 14:
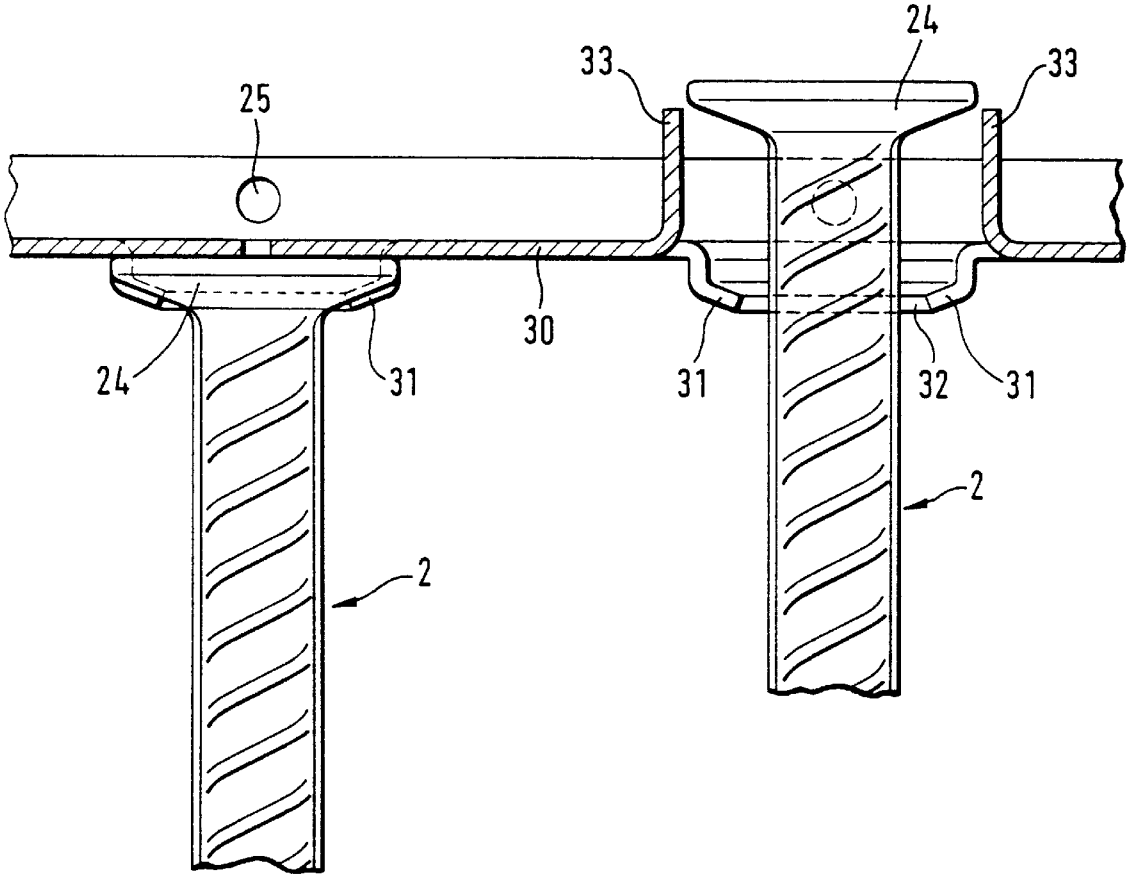

FIGS. 14 and 15 show an embodiment in which a rail 30 of a U-shaped profile is provided at its bottom with downwardly projecting bottom sections 31 between which openings 32 are formed. The central portion between the downwardly projecting bottom sections 31 is angled to form an upwardly extending section 33 so that in the bottom area of the rail 30 a sufficiently large opening for receiving the head 24 of the shear reinforcement member 2 is provided. The shear reinforcement member 2 is inserted via opening 32 from above until the head 24 rests on the downwardly projecting bottom sections 31 and, subsequently, the upwardly extending sections 33 are bent into their initial horizontal position. This is illustrated in the left half of FIG. 14 and in the representation of FIG. 15.

FIGS. 16 and 17 show the embodiment of a securing element 40 in which the shear reinforcement member 2 is surrounded in the area of the shaft 3 adjacent to the head 4 by a clamp 34 that is ring-shaped, a so-called clip. This ring clamp 34 is comprised preferably of plastic material and includes two laterally arranged snap brackets 35, 36 in addition to the ring clamp 34 surrounding the shaft. The snap brackets 35, 36 serve to fasten the securing element 40 at reinforcement bars 38 and 39 which extend horizontally within the slab floor. In this manner, the shear reinforcement members 2 can be individually arranged at any desired distance relative to one another within the slap floor construction. For facilitating mounting of the securing element 40 at the reinforcement bars 38 and 39, the snap brackets 35 and 36 at their free ends are provided with slantedly outwardly extending flaps 37.

From FIGS. 17 and 18 it can be taken that the securing element 40 is provided at one location of the ring clamp 34 with a closure 41 so that the clamp 34 can be opened for mounting on the shear reinforcement member 2. FIG. 18 shows that this closure 41 is comprised of two catch projections 42 and 43 which in the closed embodiment engage one another. In order to allow for a widening of the clamp 34 for mounting the securing element 40 at the shaft 3 of the share reinforcement member 2 in a simple manner, a joint in the form of two strips 44 and 44' thinner than the remainder of the clamp are provided which allows the ring to be opened.

Figure 19:
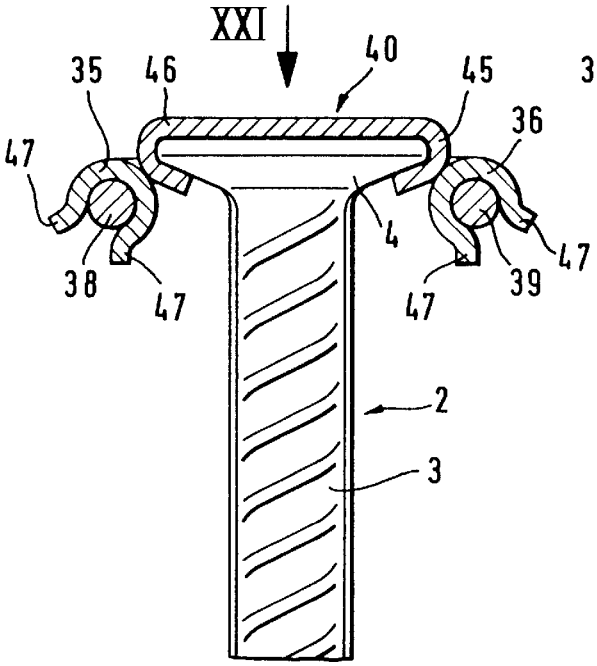
FIG. 19 shows the head of the shear reinforcement member surrounded by the securing element.
Figure 20:
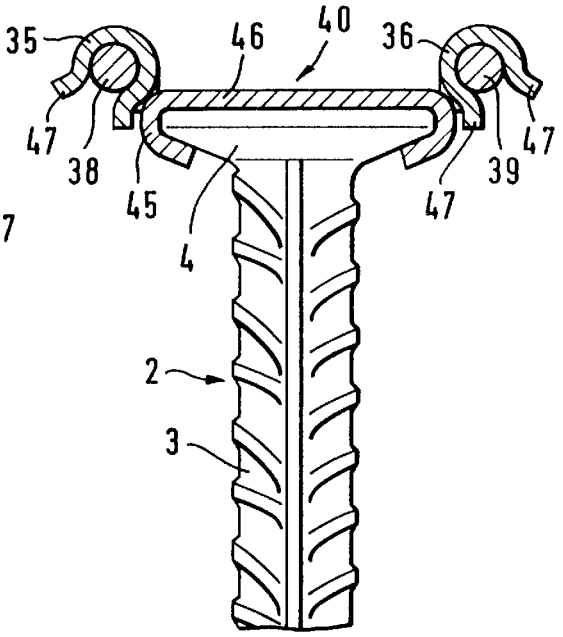
FIG. 20 shows another embodiment of the design of FIG. 19.
Figure 21:
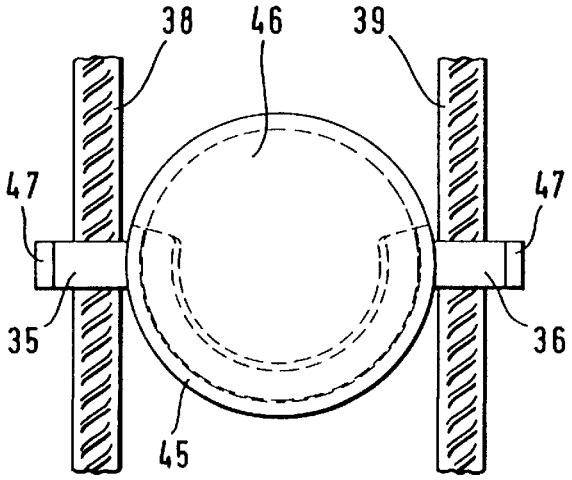
FIG. 21 shows a view in direction of arrow XXI in FIG. 19.

In FIGS. 19 to 21 different views and embodiments of the securing element 40 are shown in which the circumferential edge of the head 4 of the shear reinforcement element 2 is surrounded by a ring segment 45. This ring segment 45 surrounds the circumference of the head 4 along an angular distance of 220°. For stiffening the ring segment 45 the upper side may be provided with a disc 46 which completely covers the end face of the head 4 and which can also be used as a substrate for applying identifying markings etc. thereto. The securing element comprises snap brackets 35 and 36 that are arranged diametrically opposed to one another at the ring segment 45. The snap brackets 35, 36 have outwardly extending angular ends 47 for facilitating fastening at the reinforcement bars 38 and 39. The embodiment of FIG. 20 differs from the one represented in FIG. 19 in that the plane of the ring segment 45, respectively, of the end face of the head 4 is displaced relative to the plane in which the snap brackets 35 and 36.

Figure 22:
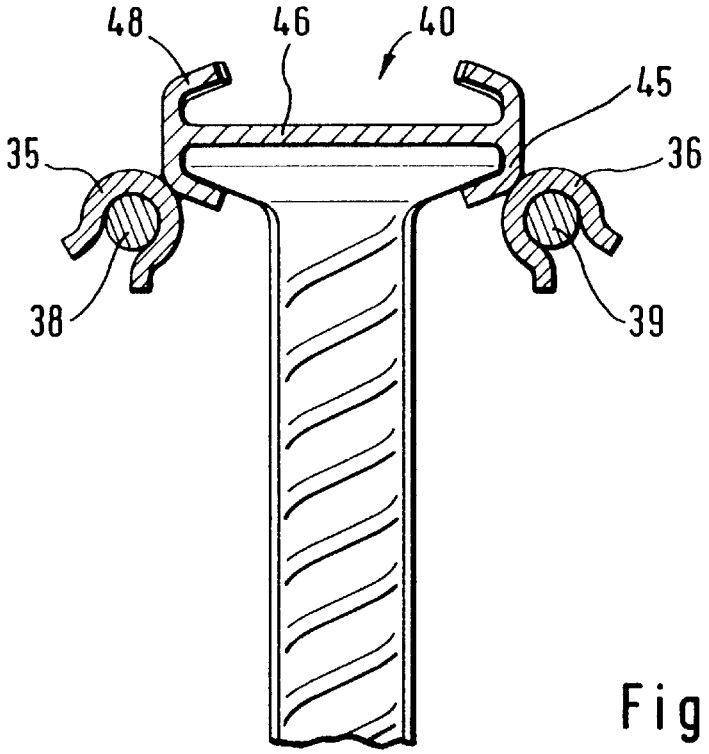
FIGS. 22 and 23 show another embodiment of the design of FIGS. 19 and 21.
Figure 23:
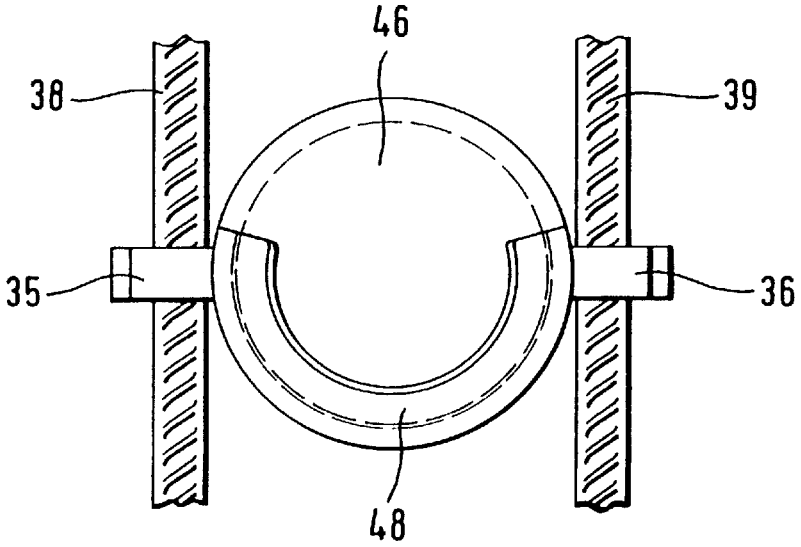

In FIGS. 22 and 23 a securing element is represented that is substantially identical of FIGS. 19 and 21. In addition, a second ring segment 48 is provided at the upper side of the disk 46 so that a second shear reinforcement member can be received therein. For the other identical parts the reference numerals are the same as in FIGS. 19 and 21.

Figure 24:
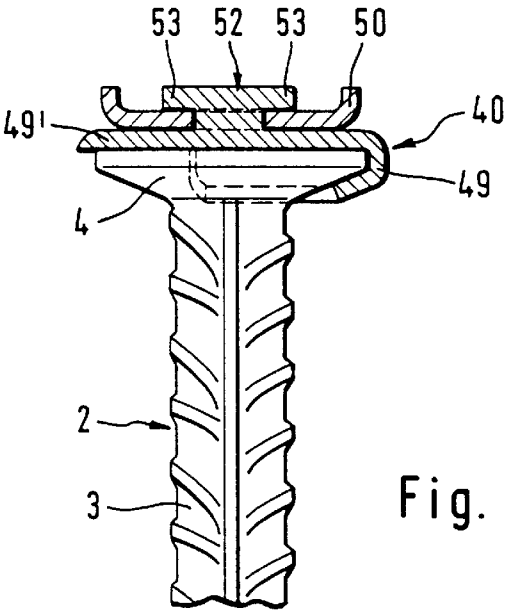
FIG. 24 shows a further embodiment for fastening the reinforcement members to the rail.

FIG. 24 shows a shear reinforcement member 2 having a head 4 to which a securing element 40 is connected which is substantially comprised of a ring segment 49 and a plate 49'. At the upper side of the plate 49' a T-shaped member 52 is integrally formed which extends through an opening into the rail 50 and the lateral arms 53 of which engage behind the rail.

Figure 25:
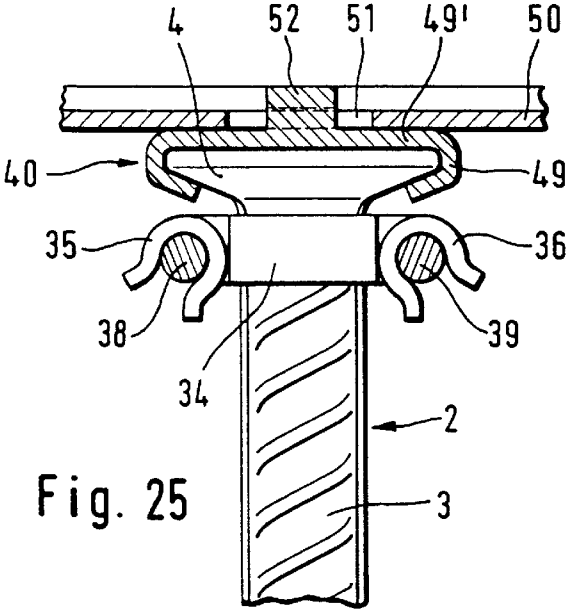
FIG. 25 shows an embodiment of a securing element for receiving a shear reinforcement member and reinforcement bars.

FIG. 25 shows a section of the securing element 40 and the rail 50 at a right angle to the view of FIG. 24. It is shown that the T-shaped member 52 extends through the opening 51 in the rail 50 whereby the opening 51 has a length that is sufficient to insert the member 52 with its lateral arms 53. By rotation about the longitudinal axis of the shear reinforcement member 2 the arms 53 engage behind the rail 50 as is shown in FIG. 24.

Figure 26:
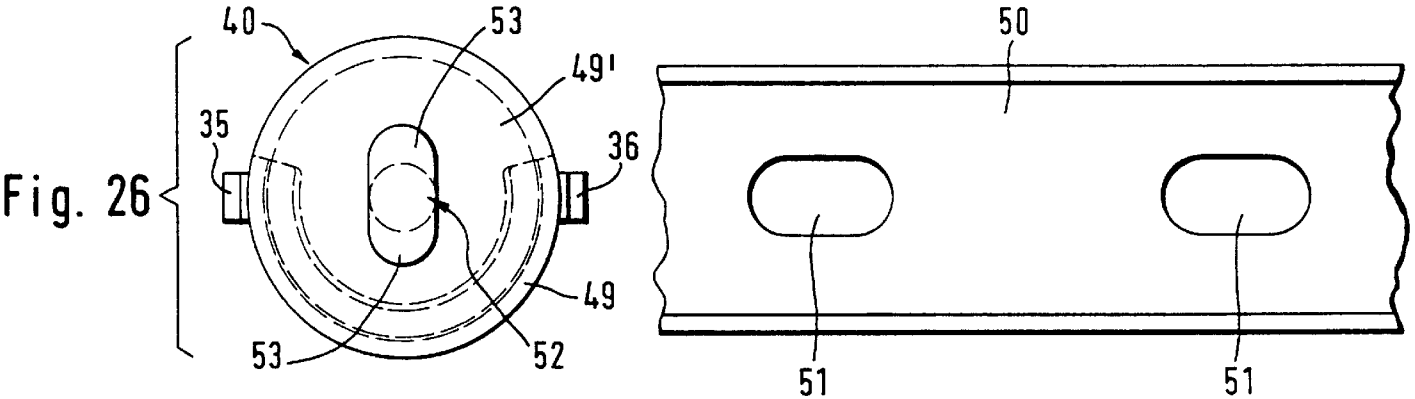
FIG. 26 shows a plan view of a securing element connected to the head of the reinforcement member and a rail before assembly.

In FIG. 25 it is shown that a ring 34 can be arranged additionally about the shaft 3 of the shear reinforcement member 2 with which a fastening to the reinforcement bars 38 and 39 is possible in the aforementioned manner. FIG. 26 shows a plan view of the securing element 40 and the rail 50 before assembly of the parts. The T-shaped member has, as is shown clearly in FIG. 26, a central portion with circular cross-section whereby this part corresponds to the distance between the flat sides of the longitudinal opening 51 of the rail 50. The two arms 53 of the member 52 have the same shape as the longitudinal extension of the opening 51 so that the member 57 with its arms 53 can be inserted through the opening. Upon rotation by 90° the securing element 40 is then locked.

The present invention is, of course, in no way restricted to the specific disclosure of the specification and drawings, but also encompasses any modifications within the scope of the appended claims.

What I claim is:

1. A shear reinforcement system for embedding in a slab floor, said system comprising:

elongate shear reinforcement members positionable transverse to a plane of a slab floor;

at least one securing element fixedly securing said elongate shear reinforcement members;

said at least one securing element extending transverse to said elongate shear reinforcement members and positionable parallel to the plane of the slab floor, wherein said at least one securing element is an elongate rail, having a U-shaped cross-section with sidewalls, receiving a plurality of said elongate shear reinforcement members;

wherein said elongate shear reinforcement members are bolts having a first and a second end and wherein at least said first end has a head;

said heads inserted into said rail and positive-lockingly and non-displaceably secured by said rail by bending wall portions of said sidewalls inwardly behind said heads.

2. A system according to claim 1, wherein said rail is comprised of a rustproof material.

3. A system according to claim 1, wherein said rail is comprised of plastic material.

4. A system according to claim 1, wherein said wall portions are delimited by perforations in said sidewalls.

5. A system according to claim 4, wherein said rail has inwardly extending projections in a regular arrangement.

6. A system according to claim 1, wherein said sidewalls have evenly spaced openings.

7. A shear reinforcement system for embedding in a slab floor, said system comprising:

elongate shear reinforcement members positionable transverse to a plane of a slab floor;

at least one securing element fixedly securing said elongate shear reinforcement members;

said at least one securing element extending transverse to said elongate shear reinforcement members and positionable parallel to the plane of the slab floor, wherein said at least one securing element is an elongate rail receiving a plurality of said elongate shear reinforcement members;

wherein said elongate shear reinforcement members are bolts having a first and a second end and wherein at least said first end has a head;

wherein said rail has a C-shaped cross-section with a base and lateral edges, wherein said heads are inserted into said rail and positive-lockingly and non-displaceably secured by said lateral edges clamping from behind said heads of said bolts.

8. A system according to claim 7, wherein said heads have a circular arc-shaped contour with opposed flattened portions, wherein a width of said head between said flattened portions is smaller than a distance between said lateral edges.

9. A system according to claim 8, wherein said rail has inwardly extending projections in a regular arrangement.

10. A system according to claim 9, wherein:

said head has depressions at said circular arc-shaped contour between said flattened portions; and said inwardly extending projections engaging said depressions.

11. A system according to claim 7, wherein said lateral edges have slots and wherein said heads have integral projections engaging said slots.

12. A system according to claim 7, wherein said rail is comprised of a rustproof material or of a plastic material.

13. A system according to claim 9, wherein:

said head has an end face facing said base and said end face has a depression; and said inwardly extending projections include projections connected to said base for engaging said depression.

14. A shear reinforcement system for embedding in a slab floor, said system comprising:

elongate shear reinforcement members positionable transverse to a plane of a slab floor;

at least one securing element fixedly securing said elongate shear reinforcement members;

said at least one securing element extending transverse to said elongate shear reinforcement members and positionable parallel to the plane of the slab floor, wherein said at least one securing element is an elongate rail receiving a plurality of said elongate shear reinforcement members;

wherein said elongate shear reinforcement members are bolts having a first and a second end and wherein at least said first end has a head;

wherein said rail has a U-shaped cross-section with a bottom and upwardly extending legs, wherein said bottom has downwardly projecting first bottom sections and wherein said heads are inserted into said rail and positive-lockingly and non-displaceably secured by said downwardly projecting first bottom sections engaging from below said heads.

15. A system according to claim 14, wherein said support surfaces are formed by second bottom sections bent after mounting of said elongate shear reinforcement members so as to rest at said end faces.

16. A system according to claim 14, wherein said upwardly extending legs have evenly spaced openings.

17. A system according to claim 14, wherein said heads have an end face and wherein said rail has support surfaces at which said end faces of said heads rest.

18. A system according to claim 14, wherein said rail is comprised of a rustproof material or of a plastic material.

19. A shear reinforcement system for embedding in a slab floor, said system comprising:

elongate shear reinforcement members positionable transverse to a plane of a slab floor;

at least one securing element fixedly securing said elongate shear reinforcement members;

said at least one securing element extending transverse to said elongate shear reinforcement members and positionable parallel to the plane of the slab floor, wherein said at least one securing element is an elongate rail receiving a plurality of said elongate shear reinforcement members;

wherein said elongate shear reinforcement members are bolts having a first and a second end;

wherein at least said first end has a head;

wherein said rail is clamped to a shaft of said bolts and comprises connectors for fastening said rail to horizontally extending reinforcement bars of the slab floor, wherein said rail is positionable directly adjacent to said head of said bolts.

20. A system according to claim 16, wherein said rail has a U-shaped cross-section with sidewalls, said sidewalls have evenly spaced openings.

21. A system according to claim 19, wherein said securing element has a ring clamp, said ring clamp having at a first location of a circumference thereof a closure and at a second location remote from said first location a joint.

22. A system according to claim 21, wherein said joint comprises at least one portion of said ring clamp being thinner than the remainder of said ring clamp in order to allow bending.

23. A system according to claim 21, wherein said securing element encloses at least a portion of a circumferential edge of said head and has fasteners for fastening said securing element to reinforcement bars of the slab floor.

24. A system according to claim 23, wherein said securing element encloses said circumferential edge of said head along an angular distance of substantially 220°.

25. A system according to claim 23, wherein said securing element comprises a disc having a first and second opposed surfaces and further comprises a first ring segment connected to said first opposed surface, wherein said head is received in said ring segment and said first opposed surface covers an end face of said head.

26. A system according to claim 25, wherein said securing element comprises a second ring segment connected to said second opposed surface for receiving said head of a coaxially arranged further one of said shear reinforcement members.

27. A system according to claim 25, wherein said disc of said securing element comprises a fastening connector at said second opposed surface for fastening said securing element to said rail.

* * * * *